US005746668A

United States Patent [19]

Ochs

[11] Patent Number: 5,746,668

[45] Date of Patent: May 5, 1998

[54] BASKETBALL RETRIEVAL APPARATUS AND SHOOTING SYSTEM

[76] Inventor: Peter Ochs, 7623 Champions Ct., Wichita, Kans. 67226

[21] Appl. No.: 599,086

[22] Filed: Feb. 9, 1996

[51] Int. Cl.[6] ..... A64B 69/00

[52] U.S. Cl. ..... 473/433

[58] Field of Search ..... 473/431–436, 473/101, 448, 433; 273/396, 397

[56] References Cited

U.S. PATENT DOCUMENTS

| | | | |
|---|---|---|---|
| 3,233,896 | 2/1966 | King . | |
| 3,342,486 | 9/1967 | Farley | 473/448 |
| 3,776,550 | 12/1973 | McNabb | 473/436 |
| 3,917,263 | 11/1975 | Wiley . | |
| 4,667,957 | 5/1987 | Joseph . | |
| 4,836,539 | 6/1989 | Knapp | 473/433 |
| 4,838,549 | 6/1989 | Woodall . | |
| 4,896,882 | 1/1990 | Coleman . | |
| 4,913,431 | 4/1990 | Jakobs | 473/433 |
| 4,936,577 | 6/1990 | Kington et al. | 473/433 |
| 5,016,875 | 5/1991 | Joseph . | |
| 5,129,648 | 7/1992 | Sweeney et al. | 473/433 |
| 5,160,138 | 11/1992 | Sanders . | |
| 5,171,009 | 12/1992 | Filewich et al. . | |
| 5,312,099 | 5/1994 | Oliver, Sr. . | |
| 5,348,290 | 9/1994 | Matherne et al. . | |
| 5,368,292 | 11/1994 | Metz . | |
| 5,393,049 | 2/1995 | Nelson . | |
| 5,409,211 | 4/1995 | Adamek . | |
| 5,540,428 | 7/1996 | Joseph | 473/433 |

*Primary Examiner*—William H. Grieb

*Attorney, Agent, or Firm*—Thorpe, North & Western, LLP

[57] ABSTRACT

A basketball retrieval apparatus and shooting system of the present invention includes a collection mechanism disposable about a conventional basketball basket for receiving basketballs, and an elongate ramp pivotably attached to a mast supporting the conventional basketball basket, and positioned at the bottom of the collection mechanism for receiving basketballs and channeling them to a player shooting at the basket. A first end of the ramp is supported by a support arm extending from the mast, and a second end has a base for holding the second end above ground level. The ramp between the first and second ends is self-supporting. The ramp is lightweight and easy to move between different shooting locations.

25 Claims, 7 Drawing Sheets

BASKETBALL RETRIEVAL APPARATUS AND SHOOTING SYSTEM

BACKGROUND OF THE INVENTION

1. Field of the Invention

The present invention relates to an apparatus for retrieving basketballs and, in particular, to an apparatus which allows the user to select the location at which the ball is returned.

2. Prior Art

When practicing the game of basketball, it is important to take numerous shots at the basketball rim or goal in order to improve the player's shooting ability and technique. To avoid the need for the player practicing to repeatedly stop and retrieve the basketball, it is common for a second player to rebound the balls used and pass them to the player practicing his or her shot. While such an arrangement is generally convenient for the shooting player, the second player spends a considerable amount of time rebounding balls with little benefit.

To avoid wasting the time of other players and because situations often arise in which a player must practice alone, numerous retrieval devices have been invented to return the basketball to the player. Such devices range from simple plastic attachments which direct the basketball back toward the player after each shot which passes through the net, to complex net and ramp arrangements which return the ball right to the player's side.

Prior to the present invention, the prior art retrieval devices have suffered from several disadvantages. First, the simple devices did not ensure that the ball would be returned directly to the player, and the player was often forced to chase balls, although to a lesser extent than before the prior art was created. Second, the more complex devices were typically stationary and only returned the ball to a given location. Those which were not stationary were often bulky and difficult to move. Additionally, if the player was shooting from beyond the device, he or she had to approach the device to retrieve the basketball and then return to the desired shooting position.

Thus, there is a need for a basketball retrieval apparatus which is simple to use and to move into a variety of positions by a single player to enable the player to repeatedly shoot at the basket without having to chase stray basketballs. Such an apparatus should also be inexpensive to use and easy to manufacture. Such a device should also enable the player to determine whether the basketball stops along the return ramp or is forwarded to the location at which the player is shooting.

SUMMARY OF THE INVENTION

It is an object of the present invention to provide a basketball retrieval apparatus and shooting system which returns a basketball to a player at a location desired by the player.

It is another object of the present invention to provide such a retrieval apparatus and shooting system which may be conveniently moved along a 180 degree arc so that the player may select the location at which the ball will be returned.

It is yet another object of the present invention to provide such a retrieval apparatus and shooting system wherein the apparatus may be moved by a single player to any location along the arcuate shooting arc.

It is still another object of the present invention to provide such a basketball retrieval apparatus and shooting system which is inexpensive and easy to use.

It is a further object of the present invention to provide such a basketball retrieval apparatus and shooting system which encourages proper shooting technique and allows practicing of bank shots.

It is still a further object of the present invention to provide such a system which stores easily and can be installed quickly.

The above and other objects of the invention are realized in specific illustrated embodiments of a basketball retrieval apparatus including a collection mechanism disposable about a conventional basketball basket for receiving basketballs therein, and an elongate ramp pivotably attached to a collection mechanism which is supported by mast supporting the conventional basketball basket, and positioned at the bottom of the collection mechanism for receiving basketballs and channeling them to a player shooting at the basket.

In accordance with one aspect of the invention, the ramp has a first end, pivotably attached to the bottom of the collection mechanism and a second end which is held above the ground by a base. The pivotable attachment of the first end enables the entire ramp to be pivoted along a 180 degree arc by simply lifting the second end from the ground and walking to the desired location along the arc.

In accordance with another aspect of the present invention, the ramp is formed from elongate pieces of polyvinylchloride tubing. The tubing is sufficiently durable to withstand the force of the basketball, but is sufficiently light that an average player can lift the second end of the ramp (the first end being supported by the mast) with one hand and move the ramp into a desired position.

In accordance with another aspect of the present invention, the collection mechanism is supported by a traditional mast, such as is used to hold the backboard and basket above the ground. In the alternative, a removable pole may be used to provide support for the collection mechanism when the basketball backboard is held above the ground by a method other than a conventional mast. In other words, the removable pole may be used to support the collection mechanism so that the same may be used with basketball baskets which are held in place by wall or ceiling mounts. When the collection mechanism is removed from the basket/backboard, the pole can be removed and stored with the collection mechanism.

In accordance with another aspect of the present invention, the collection device and the ramp may be easily assembled and disassembled to allow occasional use of the device without interfering with the ability of the basketball standard to be used in a conventional manner. The ease with which the basketball retrieval apparatus may be assembled and disassembled also allows it to be easily transported to other locations, or conveniently stored In accordance with yet another aspect of the present invention, a ball control mechanism is positioned along the ramp to selectively stop the ball adjacent the second end, or to pass the ball to the person shooting. The ball control mechanism has a first position in which a projection extends upwardly from the ramp to stop the ball from rolling beyond the control mechanism. The ball control mechanism can also be rotated into a second position in which the control mechanism forms a passing ramp extending upwardly from the basketball return ramp. As a ball rolls over the passing ramp, the ball moves upwardly, away from the return ramp, and toward the player. In such a position, the passing ramp allows the returning ball to follow a path simulating a pass from another player. Thus, the player shooting need not approach the return ramp to retrieve the ball after each shot.

By standing a short distance from the return ramp, the player can simulate catching a pass and then shooting a jump shot, etc.

In accordance with another aspect of the invention, the basketball return ramp can be made of two different sized pairs of tubes, one pair partially contained within the other. By moving the partially contained portion into or out of the larger tubes, the length of the return ramp may be adjusted. Because of the lightweight tubing, the self-nesting of the return ramp does not add significant weight and allows the player to select the location at which the ball will be returned.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
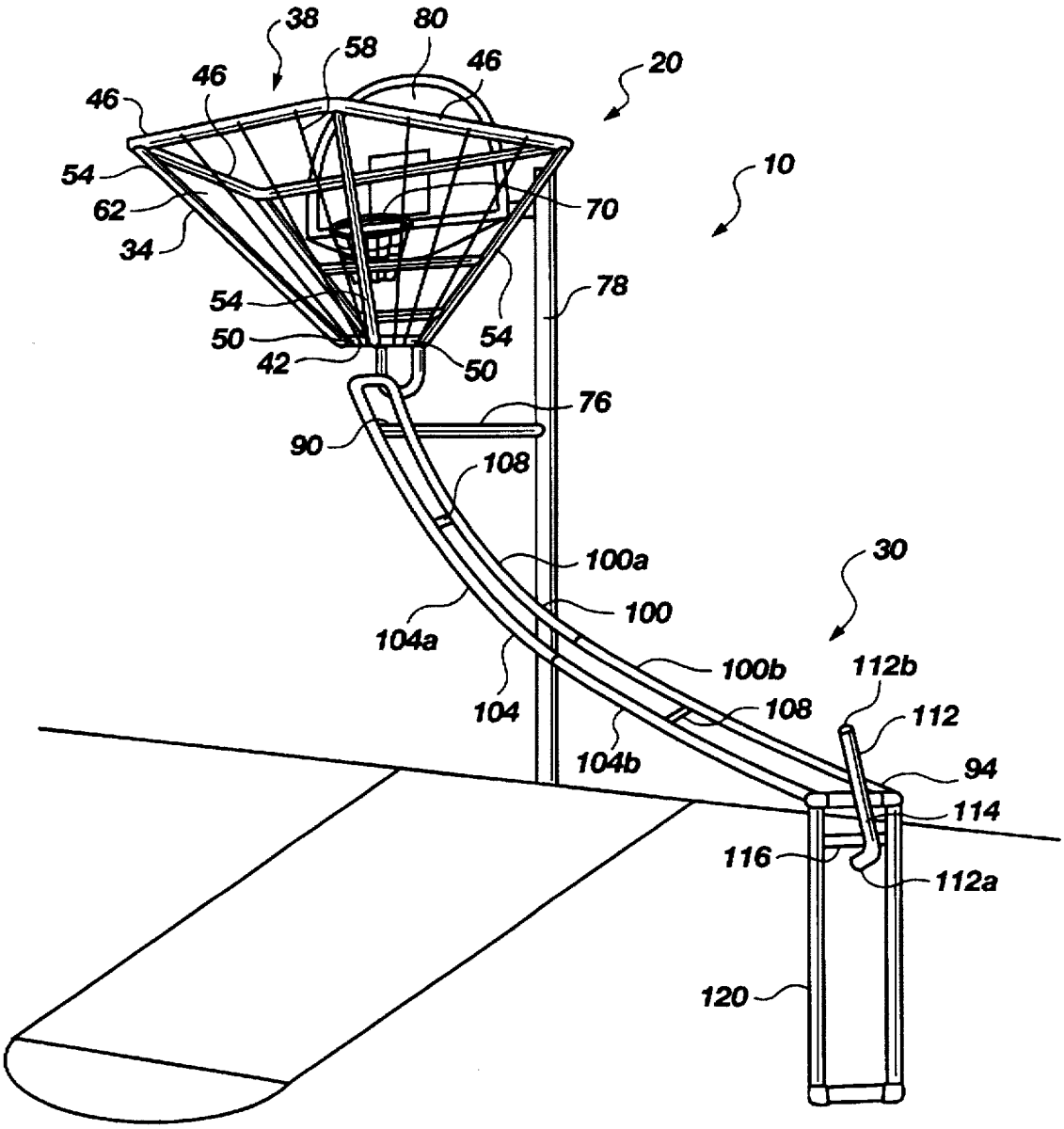
FIG. 1 shows a perspective view of a basketball retrieval apparatus made in accordance with the teachings of the present invention.

Referring to FIG. 1, there is shown a perspective view of a basketball retrieval apparatus, generally indicated at 10, made in accordance with the teachings of the present invention. The basketball retrieval apparatus 10 includes a basketball collection apparatus, generally indicated at 20, and a basketball return ramp, generally indicated at 30.

As is shown in FIG. 1, the basketball collection apparatus 20 includes a frame 34 having an upper opening 38 and a lower opening 42. The upper opening 38 is circumscribed by a plurality of interconnected tubular structures 46 so as to form a generally rectangular opening. The lower opening 42 is also formed of a plurality of interconnected tubular structures 50 which form a somewhat rounded opening.

The tubular structures forming the upper opening 38 and the lower opening 42 are connected by a plurality of elongate support tubes 54 which extend upwardly and outwardly to form a funnel shape. Also connecting the interconnected tubular structures 46 circumscribing the upper opening 38 to the interconnected tubular structures circumscribing the lower opening 42 are a plurality of strings 58. The strings 58 are interlaced with one or more horizontally disposed strings 62. As will be appreciated, the strings 58 and 62 help to channel a basketball within the collection apparatus 20 downwardly through the lower opening 42 while providing minimal interference with the ability of the player to see the rim of the basketball basket 70.

As will be discussed in additional detail with respect to FIGS. 2 and 4, the collection apparatus 20 is held in place in part by a support arm 76 which attaches to a conventional mast 78 used to support a basketball backboard 80 and basketball rim of the basket 70.

Once a basketball has been channeled through the lower opening 42, it falls onto an upper, first end 90 of the basketball return ramp 30. The upper, first end 90 of the support ramp is pivotably attached to and supported by the arm 76 which is used to support the collection apparatus 20. The pivotable attachment (shown in FIGS. 2 and 4) enables the return ramp 30 to be rotated relative to the collection apparatus 20.

Once a ball has fallen on the return ramp 30, gravity draws the ball down to the second end 94. The return ramp 30 will typically be of sufficient length that the second end 94 is disposed between ten and twenty-five feet from the basket 70.

The return ramp 30 is formed from two elongate tubular structures 100 and 104. Typically, each of the tubular structures will be formed from polyvinylchloride or some other lightweight and durable material. A plurality of braces 108 may connect the tubular structures 100 and 104 to add rigidity and to prevent the two structures from being forced away from each other by the weight of the basketball.

In contrast to the configurations of the prior art, the lightweight of the tubular structures 100 and 104, and the upper, first end 90 which is supported by the arm 76 allow the second end 94 of the return ramp 30 to be easily and conveniently swung to any position along a 180 degree arc. Thus, a player may select virtually any angle to shoot at the basketball rim 70 while the return ramp 30 is positioned nearby.

As will be appreciated, most players desire to shoot at the basket 70 not only at different angles, but also at different distances from the basketball basket. Those familiar with the prior art will appreciate that prior to the present invention, the player was forced to move to come to the return apparatus after each shot to grab the basketball. With the present invention, however, the tubular structures 100 and 104 may actually be made of two portions, upper portions **100*a* and 104*a*, and lower portions 100*b* and 104*b*. The lower portions 100*b* and 104*b* will be slightly smaller in diameter so that they will nest within the larger, upper portions 100*a* and 104*a*. Thus, the basketball return ramp 30 is able to telescope to the desired length. As the user changes shooting positions, the lower portions 100*b* and 104*b* are moved into or out of the upper portions 100***a* and 104*a*. In that the angle of the return ramp 30 may change with extreme changes in ramp length, the first end 90 of the ramp may be made to rotate relative to the support arm 76. However, because of the flexible nature of such tubing, such will generally not be necessary.

Also shown in FIG. 1 is a ball control device 112 which is positioned at the second end 94 of the return ramp. The ball control device 112 is formed by an arm 114 disposed in a rotatable attachment with the second end 94, the rotation of which is limited by a cross bar 116 attached to the base 120 which holds up the second end. As shown in FIG. 1, the ball control device 112 is disposed in a first position in which a first end 112*a* of the ball control device contacts the cross bar 116. In such a position, the opposing second end 112*b* of the control device 112 extends vertically from the return ramp 30. When a ball rolls down the ramp 30, the ball control device 112 prevents the ball from rolling off the second end 94 of the ramp. Thus, the player may shoot with several balls at the same time without worrying that the balls will roll off the ramp while he or she is shooting.

Yet another advantage of the collection apparatus 20 is that the frame 34 extends upwardly above the height of the basket 70. To make a shot, the player must provide sufficient arch to the ball to pass above the frame 34 before entering the basket 70. Repeating the motions necessary to shoot the ball over the frame 34 with each shot helps the player develop proper arch during the shot. With extensive use, muscle memory will be developed for proper shooting.

Figure 2:
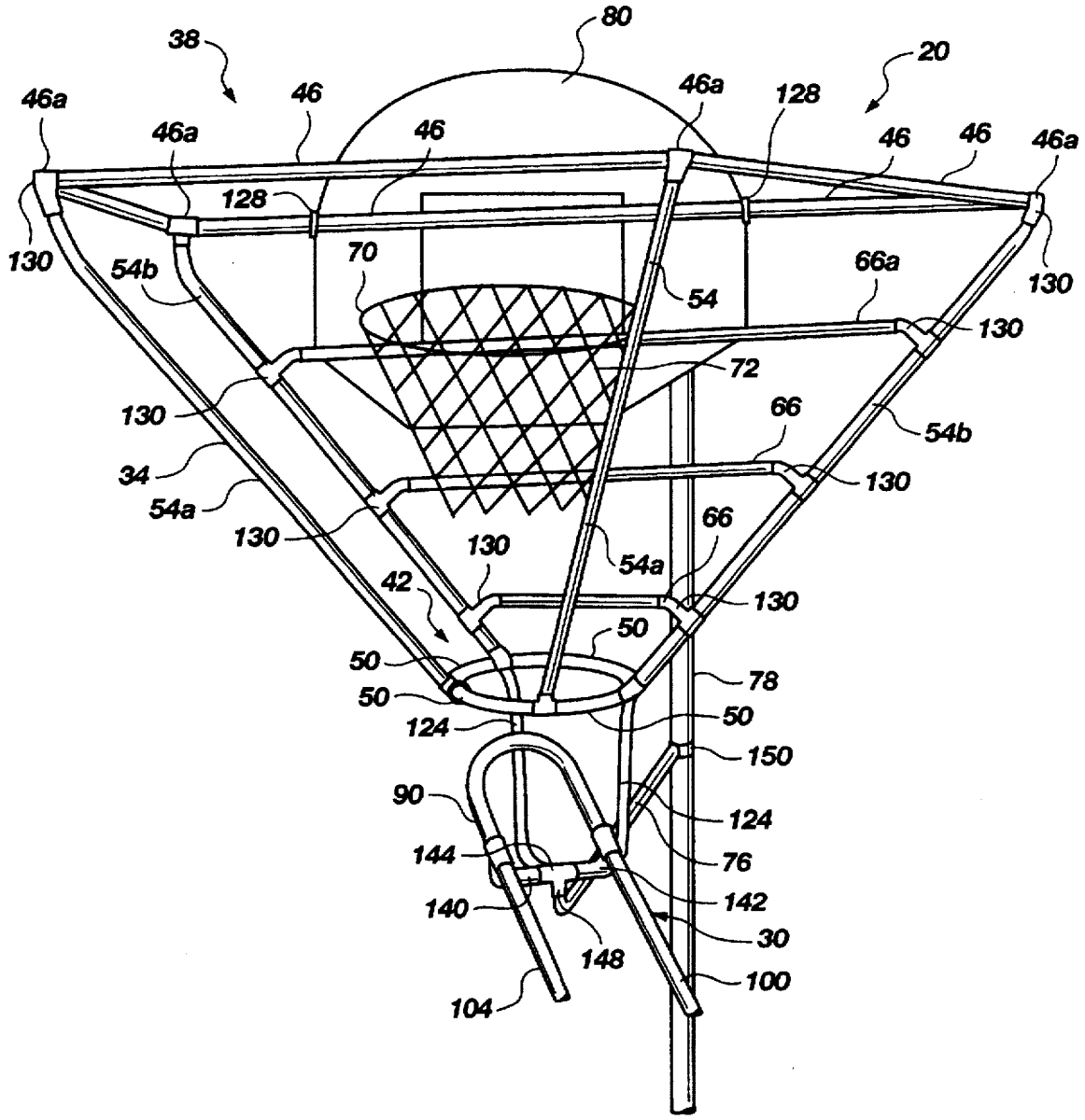
FIG. 2 shows a close-up view of the collection device and fragmented view of the first end of the return ramp of the present invention.

Referring now to FIG. 2, there is shown a close-up view of the collection apparatus 20. The frame 34 is formed of a plurality of interconnecting tubes formed from polyvinylchloride or some other durable, lightweight material. The tubular structures 46 of the frame 34 which form the upper opening are four generally straight pieces of PVC tubing which are attached to each other at opposing ends so as to form a square. At the point of attachment 46*a*, the four generally straight pieces of PVC are connected to the support tubes 54 which are also typically formed of PVC or some similar material. The support tubes 54 are disposed at an angle to form a funnel shaped, thereby directing a basketball disposed therein to the lower opening 42 which is formed by four smaller tubes 50 which are also connected to the support tubes 54.

As was shown in FIG. 1, the support tubes 54 which are disposed in the front, i.e. tubes 54*a*, are connected to the other tubes by the horizontally disposed strings 62. The rear tubes, 54*b*, however are connected to one another by a plurality of cross-supports 66 which extend adjacent the backboard 80. An uppermost cross-support 66*a* rests on the flange 72 which attaches the basket 70 to the backboard 80. The cross-supports 66 also help to provide rigidity to the frame 34 by preventing any significant movement of the rear support tubes 54*b*.

Disposed below the lower opening 42 are a pair of vertical supports 124 which attach the frame 34 to the support arm 76 which is connected to the mast 78. The support arm 76 helps to hold the frame 34 in place and inhibits movement of the same. To further reduce movement of the frame 34, straps 128 may be used to secure the rear most tubular structure 46*b* to the mast 78 supporting the backboard 80.

As will be appreciated from the view shown in FIG. 2, the tubes are all connected by conventional attachments 130. The interior of the attachments 130 can be coated with an adhesive to make the frame 34 fixed. However, the attachments 130 can also be disposed in frictional engagement with the tubes, or provided with removable pins to hold the frame together. Thus, the frame 34 may be easily assembled or disassembled, thereby allowing the basketball backboard 80 to be used without the frame 34 when desired. The entire apparatus can typically be lifted off of the backboard by a single person standing on the ground.

Disposed below the lower opening 42 is the upper, first end 90 of the basketball return ramp 30. The two tubes 100 and 104 are connected by a support 140 which keeps them spaced apart the appropriate distance. The support 140 is formed by two curved tubes 142 which are connected by a T-shaped connector 144. The lower end 148 of the T-shaped connector 144 forms a rotatable/pivotable engagement with the end of the support arm 76. This rotatable engagement allows the basketball return ramp 30 to be pivoted with respect to the collection apparatus 20. Thus, the user can select his or her shooting position and move the return ramp 30 to that position.

The engagement between the curved tubes 140 of the support 140 and the T-shaped connector 144 may also allow upward and downward rotation of the basketball return ramp 30 relative to the support arm. Thus, if the return ramp 30 can extend or retract in the manner discussed with respect to FIG. 1, the angle of the first end 90 of the ramp 30 can be adjusted. However, because the tubes 100 and 104 are somewhat flexible, the need for such rotatable engagement is minimal.

The opposing end of the support arm 76 will typically be held to the mast 78 by a band clamp 150 or similar device to secure the support arm and the other structures it supports. When the frame 34 is to be removed from a basketball backboard 80, releasing the band clamp 150 or similar device will allow the entire frame to be lifted off the backboard. Because of the material from which the frame 34 is made, this can be accomplished by a single person standing on the ground if necessary.

Figure 3B:
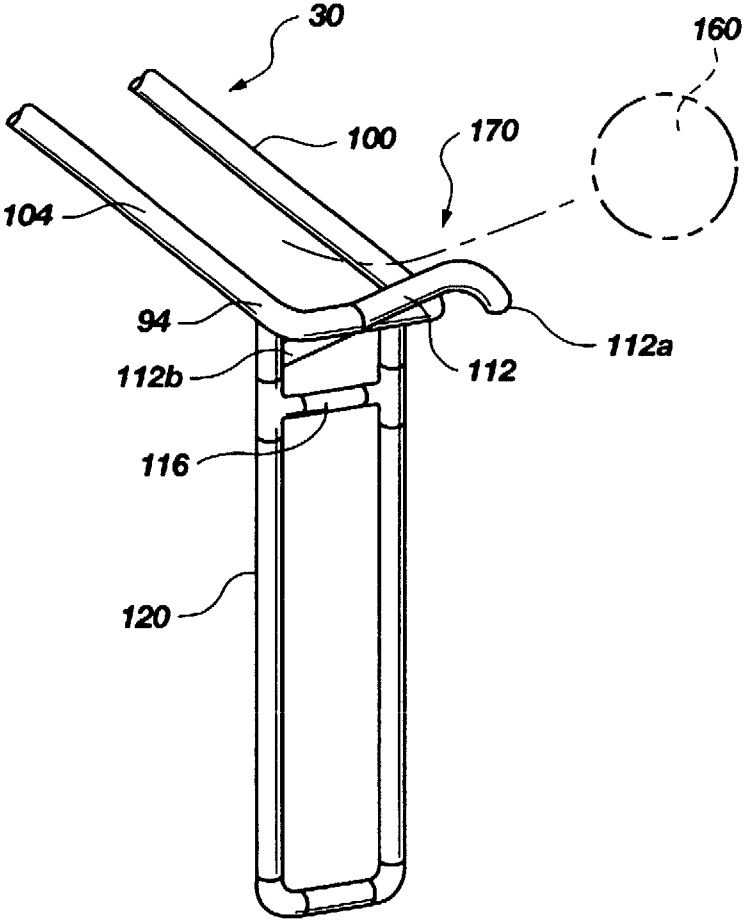
FIG. 3B shows a fragmented, close-up view of the return ramp with the ball control device positioned to pass the ball rolling down the ramp to the shooting player.
Figure 3A:
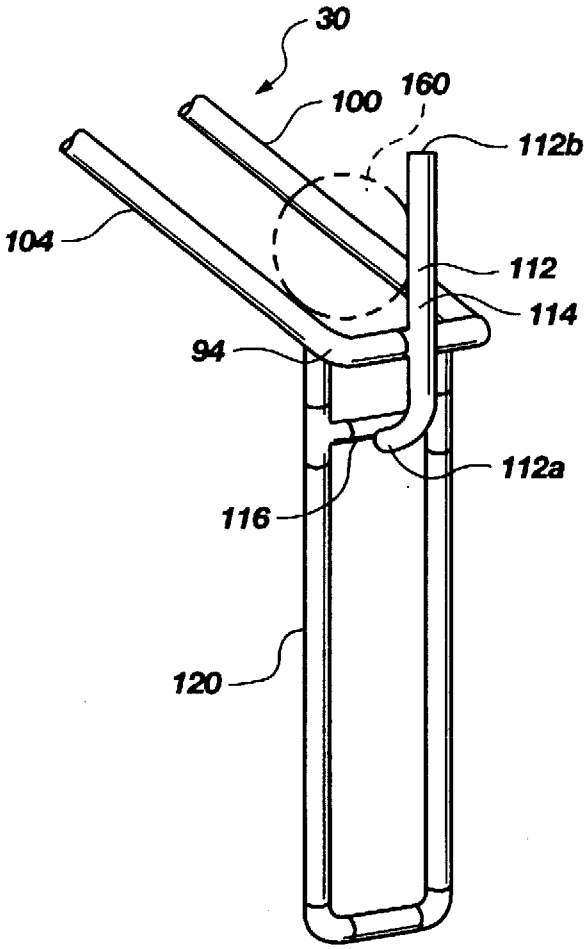
FIG. 3A shows a fragmented, close-up view of the return ramp with the ball control device positioned thereon to stop balls rolling down the return ramp.

Referring now to FIG. 3A, there is shown a close-up view of the second end 94 of the basketball return ramp 30 and the control device 112 which is disposed thereon to control the final placement of the basketball, shown in shadow at 160. As shown in FIG. 3A, the arm 114 of the control device 112 is disposed in a first position wherein the first end 112*a* is disposed against the cross-bar 116 which is disposed on the base 120. The base 120 holds the second end 94 off the ground at a convenient height for basketball retrieval.

In the first position, the second end 1122 of the control device 112 extends upwardly from the second end 94 of the return ramp 30 to prevent the basketball 160 from passing beyond the second end of the ramp. In such a position, the ball comes to a rest adjacent the second end where it may be retrieved from the ramp when needed. If several basketballs are being used, the balls will stop adjacent one another adjacent the second end.

Referring now to FIG. 3B, there is shown a close-up view of the second end 94 of the ramp 30. The control device 112 has been rotated into a second position wherein the second end 112*b* of the control device is positioned adjacent the cross-bar 116. The first end 112*a* of the control device extends upwardly and outwardly from the basketball return ramp 30 to form a passing ramp, generally indicated at 170. The passing ramp 170 is generally positioned transverse to the basketball return ramp 30 at an angle of less than 30 degrees.

Rather than stopping the basketball 160 on the basketball return ramp 30, the passing ramp 170 provides an upward projection to the basketball 160. Typically the user will be standing close enough to the basketball return ramp 30 that the basketball will still be airborne when caught by the person shooting. Thus, the passing ramp 160 simulates a pass received by the shooter, and allows the shooter to practice rapidly taking shots after catching a pass. Those familiar with the game of basketball will appreciate that the ability to shoot quickly after receipt of the ball is an important component of a good "jump shot".

The passing ramp 170 also enables a player to practice shooting from distances which are well beyond the range of conventional return ramps. Rather than being forced to return to the ramp after each shot, the player may position the basketball return ramp 30 so that balls rolling down the ramp will bounce right to him or her. If the player is sufficiently close to the passing ramp 170, the basketball would bounce similar to a bounce pass. Even if the player is standing far from the ramp, however, the ball will roll to the desired position. While other devices have attached to the basket to allow the ball to be directed back toward the court, they generally provide insufficient direction to the ball to be of any appreciable use to the player practicing shots beyond the "three-point line" or other positions far from the basket.

Figure 4:
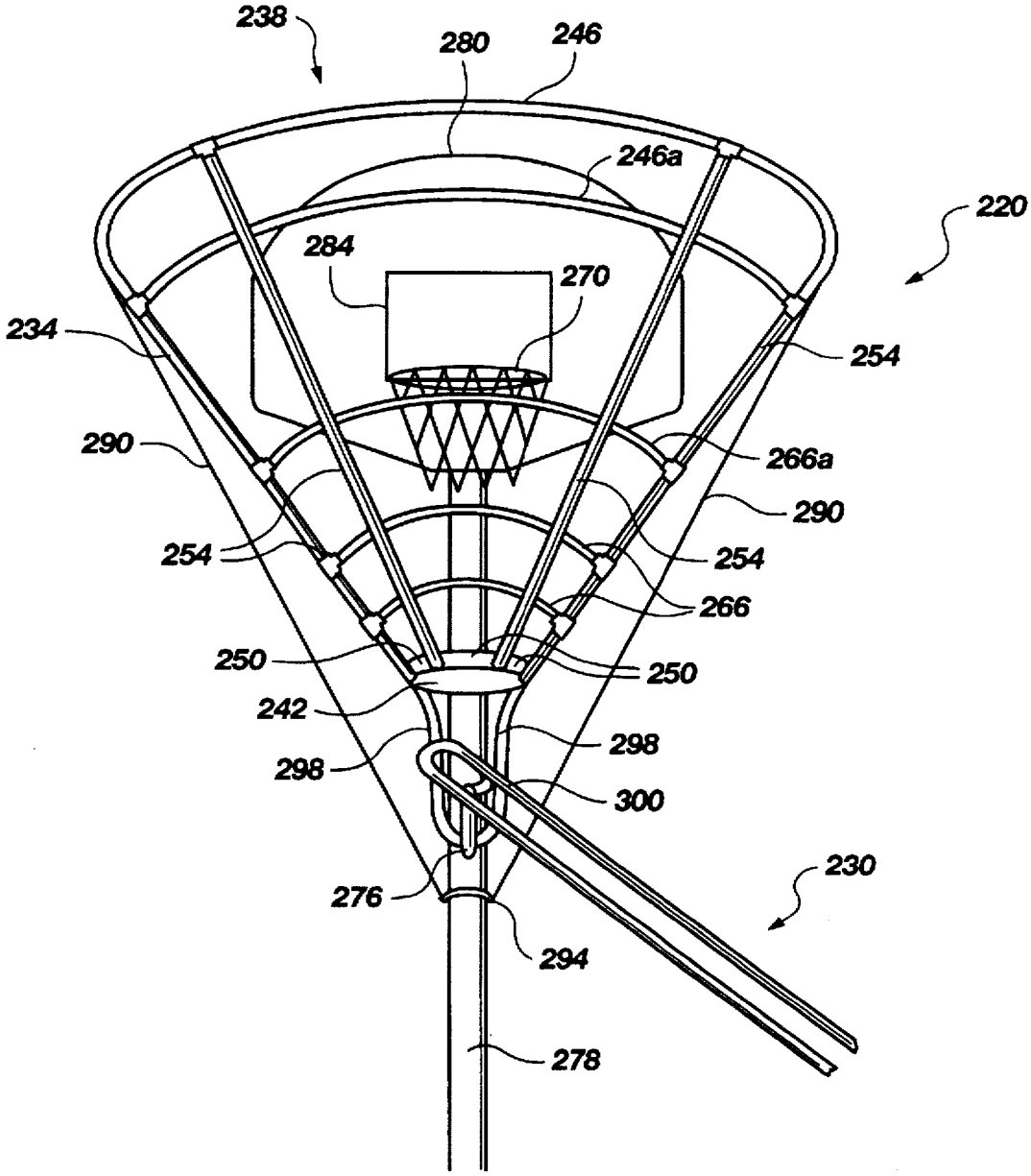
FIG. 4 shows a close-up view of an alternate embodiment of the collection device and a fragmented view of the first end of the return ramp in accordance with the principles of the present invention.

Referring now to FIG. 4, there is shown a fragmented, close-up view of an alternate embodiment of the collection apparatus, generally indicated at 220, and basketball return ramp, generally indicated at 230. The collection apparatus 220 includes a frame 234 defining an upper, larger opening 238 and a lower, smaller opening 242. Between the upper opening 238 and the lower opening 242 are a plurality of tubular structures including a plurality of tubes 246 defining the upper opening, a plurality of tubes 250 defining the lower opening, and a plurality of support tubes 254 disposed therebetween to form a funnel sloping inwardly from the upper opening to the lower opening.

While not shown in FIG. 4, the tubes 246 and 250 defining the upper and lower openings 238 and 242, are connected by a strings disposed between the support tubes 254 in a manner similar to that shown in FIG. 1. Strings are also strung horizontally between the support tubes 254 to form a net to thereby prevent a basketball from passing out of the collection apparatus 220 between the support tubes.

Support for the collection apparatus is provided by a plurality of cross-supports 266 which extend between the rearmost support tubes **254*b*. Unlike the cross-supports 66*a* shown in FIGS. 1 and 2, the cross-supports 266 are broadly rounded. Because of the curvature, the upper most cross-support 266*a* is able to hang on the flange (not shown) which attaches the basket 270 to the backboard 280 while covering a minimal portion of the backboard along locations which the basketball is likely to contact. To further decrease inference with shooting, the rearmost tube 246 of the upper plurality of tubes 246 defining the upper opening 238 is rounded or arched to move the tube further from the basket 270. In such a position, the tube 246*a* is less likely to interfere with a basketball contacting the backboard 280, especially in the area of the square 284 which is positioned on the backboard above the basket 270**.

The collection apparatus 220 is supported by the upper most cross-support **266*a*, and by a pair of retention straps 290 which are attached to a band 294 disposed about the mast 278 supporting the backboard 280 and basket 270. Additionally support is also provided by vertical supports 298 which connect the collection apparatus 220 to a support arm 276 which is attached to the mast 278**.

The support arm 276 is also attached to the first end 300 of the basketball return ramp 230 such that the ramp may be pivoted relative to the collection apparatus 220 through a range of motion of approximately 180 degrees. By supporting the first end 300, the support arm 276 facilitates movement of the entire ramp 230 simply by lifting the opposing end (not shown) and carrying it to the desired location.

Figure 5B:
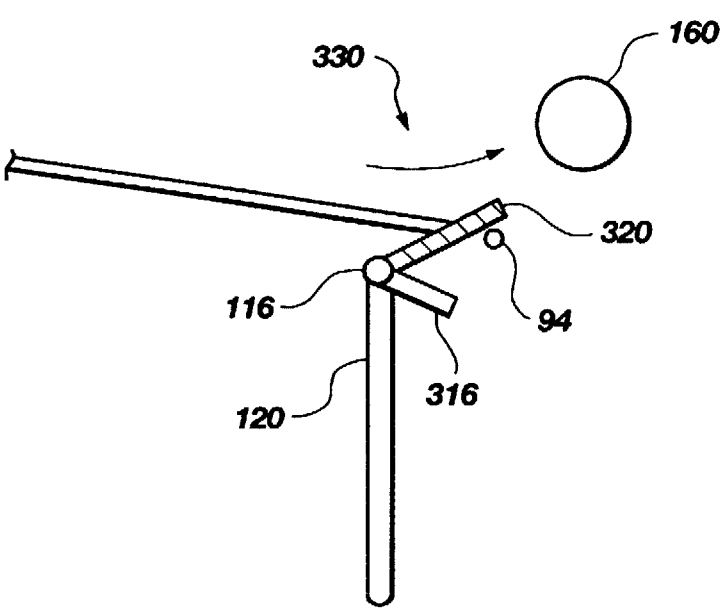
FIG. 5B shows a fragmented, close-up view of the return ramp with the ball control device shown in FIG. 5B, the control device being positioned to pass the ball to a player.
Figure 5A:
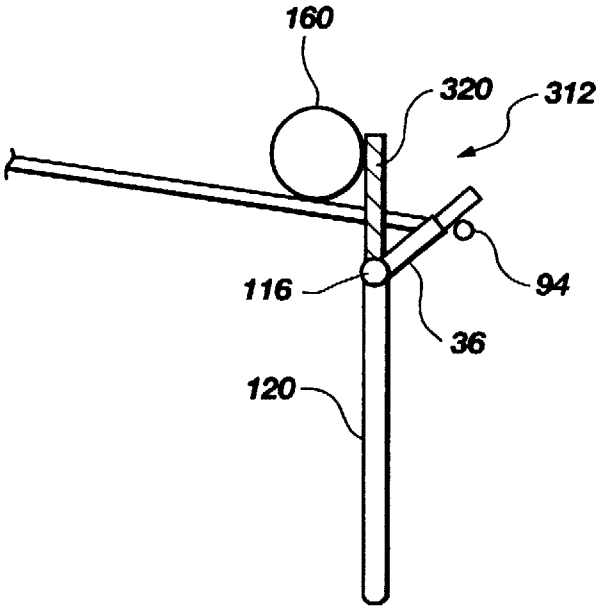
FIG. 5A shows a fragmented, close-up view of an alternated embodiment of a ball control device positioned adjacent an end of the return ramp.

Referring now to FIG. 5A, there is shown a fragmented, partial cross-sectional view of a second end 94 of the basketball return ramp 30 and a control device 312 which selectively stops a basketball 160 at the second end of the ramp. The control device 312 is attached to the cross-bar 116 which stabilizes the base 120. Instead of having two ends, the position of which determines whether the ball 160 will be stopped, the embodiment shown in FIG. 5A uses a control device with a collapsible first arm 316 and a non-collapsible second arm 320. When the first arm 316 is extended and positioned against the second end 94 of the return ramp 30, as shown in FIG. 5A, the control device 312 is in a first position wherein the second arm 320 extends upwardly from the ramp 30 to stop the basketball 160.

When the first arm 316 is collapsed, the second arm 320 can be rotated rearwardly into contact with the second end 94. In such a position, the second arm 320 forms a passing ramp 330 which allows the ball 160 to travel on to the player. Thus, the player need not approach the basketball return ramp 30 after each shot. Such an arrangement facilitates both practice of jump shots and practice of long range shooting.

Figure 6:
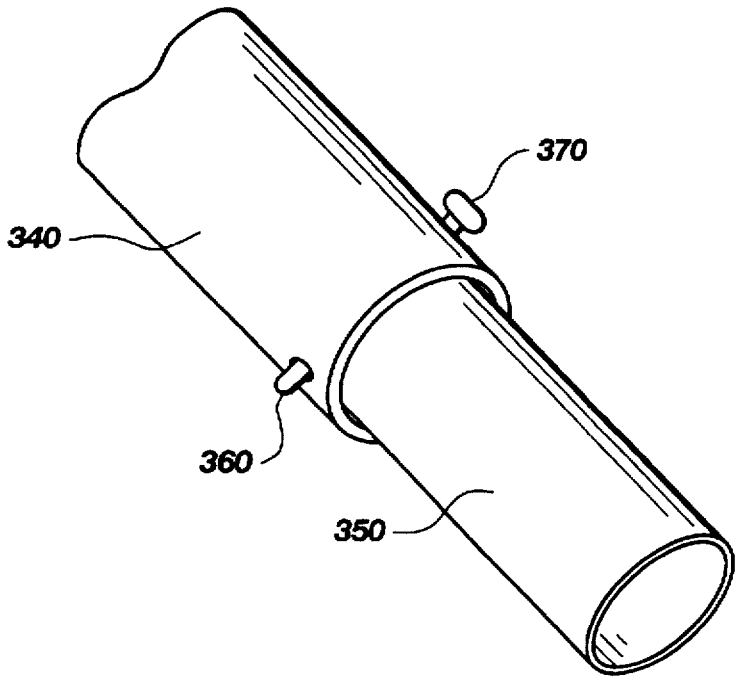
FIG. 6 shows a fragmented, close-up view of the interconnection between two tubes used to form the basketball retrieval apparatus of the present invention.

Referring now to FIG. 6, there is shown a close-up view of the attachment between two tubes, 340 and 350. While PVC and other types of tubing are typically adhesively attached, one object of the present invention is to provide a collapsible retrieval device so that the device can be used when desired and stored when not needed. To facilitate assembly and disassembly, a hole 360 is drilled through the tubes 340 and 350 and a pin 370 is positioned through the hole to hold the tubes together. Those skilled in the art will appreciate that the tubes 340 and 350 could be a conventional PVC tube and a connector which would conventionally be held together by adhesive. In the alternative, the tubes 340 and 350 could be the upper and lower portions **100*a*, 100*b*, 104*a* and 104*b*, of the telescoping basketball return ramp 30 (FIG. 1). By removing the pin 370, the length which the lower portion of the tubes 100*b* and 104*b* extends from the upper portions 100*a* can be quickly and easily adjusted. Once the desired length is achieved, the pin 370** is reinserted. Of course, either the upper or lower portion would have several holes spaced an regular intervals to facilitate adjustment.

Figure 7:
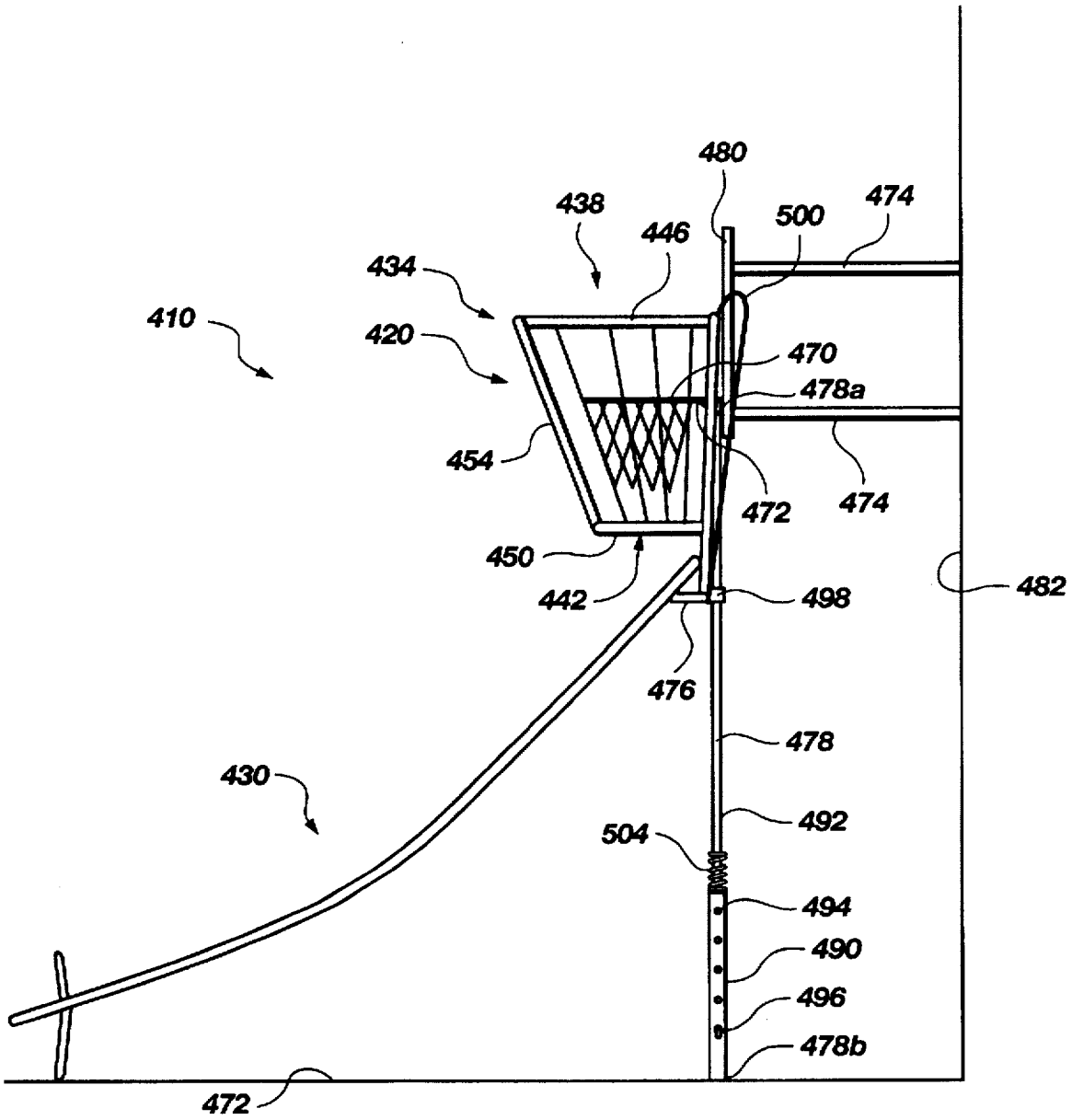
FIG. 7 shows a side view of an alternate embodiment of the present invention wherein a removable pole is used to hold the collection mechanism of the present invention.

Referring now to FIG. 7, there is shown a side view of a basketball retrieval apparatus and shooting system, generally indicated at 410. The apparatus 410 includes a collection apparatus 420 and a ramp 430. As with the previously discussed embodiments, the collection apparatus 420 is formed with a frame 434 defining an upper opening 438 and a lower opening 442. The upper opening 438 is formed by a plurality of tubular structures 446. The tubular structures 438 and 442 are connected by elongate support tubes 454 in a similar manner to that discussed above.

Unlike the previous figures, the basketball basket and backboard 470 and 480 shown in FIG. 7 are held above the ground 472 by arms 474 which are attached to a wall 482. Those familiar with basketball will appreciate that schools and gymnasiums typically have basketball backboards 480 and baskets 480 which are either mounted to a wall or a suspended from the ceiling. Many of these arrangements allow the backboard 480 and basket 470 to retract so that the court can be used for other purposes.

Because there is no mast, as shown in FIG. 1, extending to the ground in such arrangements, the collection apparatus 420 must be held in place in an alternate method. In the present embodiment, this is accomplished by providing a vertically disposed, removable pole 478, referred to hereafter as a wedge pole. The removable wedge pole 478 has a base 490 and an extension tube 492 which is nested within the base and extendable therefrom. The base is also provided with a plurality of holes 494 which can be used to insert a pin 496 to hold the extension tube 478 in place.

To hold the removable wedge pole 478 in place, a top end 478*a* of the pole 478 is forced into contact with the bottom of the flange 472 which attaches the basket 470 to the backboard 480 while the opposing end 478*b* rests on the ground. Once the upper end 478*a* of the wedge pole 478 is forcibly engaged with the flange 472, the pin 496 is inserted in the base 490, thereby holding the wedge pole in place.

Disposed along the wedge pole 478 is a connector 498 which is used to attached a support arm 476 which supports the ramp 430 in the same manner as that described with respect to FIG. 1. To further support the collection apparatus 420, straps 500 are attached to the tubular structures 446, which are looped over the backboard 480 and attached at an opposing end adjacent the connector 498.

The wedge pole 478 allows the collection apparatus 420 to be used with a basketball basket 470 and backboard 480 regardless of how they are suspended above the ground. It can also be used with basketball baskets and backboards 470 and 480 at different heights. Such an arrangement is particularly beneficial for schools and gymnasiums having retractable basketball backboards. The base 490 and the extension tube 492 are typically made of PVC or aluminum so that the wedge pole 478 is lightweight and easy to move. Additionally, a spring 504 can be provided to ensure that the extension tube 492 remains forcibly engaged to the lower side of the flange 472 (or backboard) even if the backboard 480 and basket 470 move slightly in response to the impact of a basketball.

Thus, there is disclosed an improved basketball retrieval apparatus. Those skilled in the art will appreciate that numerous modifications can be made without departing from the scope and spirit of the present invention. The appended claims are intended to cover such modifications.

What is claimed is:

1. A basketball retrieval apparatus for attachment to a basketball backboard/basket supported by a mast, the basketball retrieval apparatus comprising:

collection means disposed about the basket, the collection means having an upper opening and a lower opening;

a basketball return ramp having a first end and a second end, the first end being disposed adjacent the collection means and below the lower opening, the basketball return ramp being pivotable adjacent the first end such that movement of the second end causes the first end to pivot with respect to the collection means; and support means for holding the collection means adjacent the backboard/basket for supporting the first end in a pivotable attachment adjacent the collection means the support means comprising a support arm configured at one end for attachment to the mast and at an opposing end for attachment to the basketball return ramp for attaching the collection means and the first end of the basketball return means to the mast of the basketball standard adjacent the backboard.

2. The basketball retrieval apparatus of claim 1, wherein the collection means comprises a plurality of interconnected tubular structures.

3. The basketball retrieval apparatus of claim 2, wherein the tubular structures are formed of polyvinylchloride.

4. The basketball retrieval apparatus of claim 1, wherein the second end of the basketball return ramp comprises a base for holding said second end above ground level.

5. The basketball retrieval apparatus of claim 1, wherein the first end of the return ramp is pivotably attached to the support arm by a pivotable connector attached to the support arm.

6. The basketball retrieval apparatus of claim 1, wherein the basketball return ramp is unsupported between the first end and the second end.

7. The basketball retrieval apparatus of claim 1, wherein the basketball return ramp comprises a pair of elongate tubes disposed parallel to one another, the tubes being attached at the first and second ends of the ramp.

8. The basketball retrieval apparatus of claim 7, further comprising a plurality of braces extending from one elongate tube to another to maintain the tubes a constant distance apart from one another.

9. The basketball retrieval apparatus of claim 1, wherein the basketball return ramp comprises telescoping means for changing a length of the return ramp.

10. The basketball retrieval

A basketball retrieval apparatus for attachment to a basketball backboard/basket comprising:

collection means disposed about the basket, the collection means having an upper opening and a lower opening;

a basketball return ramp having a first end and a second end, the first end being disposed adjacent the collection means and below the lower opening, the basketball return ramp being pivotable adjacent the first end such that movement of the second end causes the first end to pivot with respect to the collection means;

support means for holding the collection means adjacent the backboard/basket and for supporting the first end in a pivotable attachment adjacent the collection means; and a basketball control device disposed at the second end of the basketball return ramp for selectively stopping any basketballs rolling down the return ramp at the second end, the control device having a first position wherein the control device prevents balls from passing beyond the second end of the ramp, and a second position wherein the control device does not stop basketballs at the second end of the return ramp; and wherein the control device comprises an arm, the arm being disposed generally vertically when the control device is disposed in the first position and inclined upwardly at an angle less than 45 degrees from the return ramp when in the second position.

11. The basketball retrieval apparatus of claim 10 wherein the arm is configured to form a passing ramp extending transversely from the basketball return ramp when disposed in the second position.

12. A basketball retrieval apparatus for attachment to a basketball backboard and basket attached to the backboard by a flange, the basketball retrieval apparatus comprising:

collection means disposed about the basket, the collection means having an upper opening and a lower opening;

a basketball return ramp having a first end and a second end, the first end being disposed adjacent the collection means and below the lower opening, the basketball return ramp being pivotable adjacent the first end such that movement of the second end causes the first end to pivot with respect to the collection means; and support means for holding the collection means adjacent the backboard/basket for supporting the first end in a pivotable attachment adjacent the collection means;

wherein the collection apparatus includes a plurality of generally vertically extending support tubes, at least two of the support tubes being disposable adjacent the backboard; and wherein the support means comprises a cross-support extending between said at least two support tubes, the cross-support being disposable on the flange attaching the basket to the backboard so as to support the collection apparatus.

13. A basketball retrieval apparatus for attachment to a basketball backboard/basket comprising:

collection means disposed about the basket, the collection means having an upper opening and a lower opening;

a basketball return ramp having a first end and a second end, the first end being disposed adjacent the collection means and below the lower opening, the basketball return ramp being pivotable adjacent the first end such that movement of the second end causes the first end to pivot with respect to the collection means; and support means for holding the collection means adjacent the backboard/basket and for supporting the first end in a pivotable attachment adjacent the collection means;

wherein the support means comprises a removable pole extending generally vertically below the backboard/basket, the removable pole comprising a base member disposable on the ground, and an extension member extendable from the base member into a wedged contact with the basketball backboard/basket so as to secure the removable pose in a vertical position, and wherein the support means further comprises a support arm attached to the removable pole, to the collection means and to the return ramp.

14. A basketball retrieval apparatus for attachment to a basketball backboard/basket supported by a mast, for returning basketballs to a person shooting the same at the basket, the retrieval apparatus comprising:

collection means disposed about the basket, the collection means forming a funnel having an upper, larger opening and a lower, smaller opening, the collection means including a plurality of tubes for defining the upper, larger opening, at least one of the tubes being disposed adjacent the backboard, and wherein said at least one tube is broadly rounded;

a basketball return ramp having a first end and a second end, the first end being disposed adjacent the collection means and below the lower, smaller opening, the basketball return ramp being pivotable adjacent the first end such that arcuate movement of the second end causes the first end to pivot with respect to the collection means; and support means for holding the collecting means adjacent the backboard/basket and for holding the first end in a pivotable attachment adjacent the lower opening of the collection means, the support means comprising a support arm attached to the mast.

15. The basketball retrieval apparatus of claim 14, wherein return ramp has a base disposed at the second end for holding the second end above ground level.

16. The basketball retrieval apparatus of claim 15, wherein the return ramp includes a pair of elongate tubes extending from the first end to the second end, and wherein the tubes are self-supporting between the first and second ends.

17. The basketball retrieval apparatus of claim 14, wherein the support means further comprises a plurality of retention straps attached to the collection apparatus and to the mast to steady the collection apparatus relative to the mast.

18. A basketball retrieval apparatus for attachment to a basketball backboard/basket supported by a mast, for returning basketballs to a person shooting the same at the basket, the retrieval apparatus comprising:

collection means disposed about the basket, the collection means forming a funnel having an upper, larger opening and a lower, smaller opening;

a basketball return ramp having a first end and a second end, the first end being disposed adjacent the collection means and below the lower, smaller opening, the basketball return ramp being pivotable adjacent the first end such that arcuate movement of the second end causes the first end to pivot with respect to the collection means; and support means for holding the collection means adjacent the backboard/basket and for holding the first end in a pivotable attachment adjacent the lower opening of the collection means, the support means comprising a support arm attached to the mast; and wherein the return ramp further comprises a basketball control device for selectively stopping basketballs at the second end of the return ramp, the control device having a first position wherein the control device prevents balls on the return ramp from passing beyond the second end, and a second position wherein the control device does not prevent balls on the return ramp from passing beyond the second end, the control device further comprising an arm, at least a portion of which is generally vertically when the control device is in the first position, and which is disposed at an incline when the control device is in the second position so as to cause a basketball passing thereover to travel upwardly as it passes beyond the second end of the basketball return ramp.

19. The basketball retrieval apparatus of claim 18, wherein the return ramp comprises telescoping means for changing the return ramp's length.

20. A basketball retrieval apparatus for attachment to a basketball backboard/basket supported by a mast above the ground the basket being attached to the backboard by a flange, for returning basketballs to a person shooting the same at the basket, the retrieval apparatus comprising:

collection means disposed about the basket, the collection means having a plurality of upwardly extending support tubes forming a funnel having an upper, larger opening and a lower, smaller opening, at least cross-support extending between the support tubes, the cross-support being configured for resting on the flange so as to support the collection means;

basketball return ramp having a first end and a second end, the first end being disposed adjacent the collection means and below the lower, smaller opening, the basketball return ramp being pivotable adjacent the first end such that arcuate movement of the second end causes the first end to pivot with respect to the collection means;

support means for holding the collection means adjacent the backboard/basket and for holding the first end in a pivotable attachment adjacent the lower opening of the collection means, the support means comprising a support arm attached to the mast; and a base disposed below the second end of the return ramp such that the return ramp is not supported between the pivotable attachment of the first end and the base at the second end.

21. The basketball retrieval apparatus of claim 20, wherein the collection means is disposed adjacent the backboard so as to extend above the basket.

22. The basketball retrieval apparatus of claim 20, wherein the collection means is releasably attachable to the backboard/basket so as to enable a single person to remove the collection mechanism from the backboard/basket while standing on the ground.

23. A basketball retrieval apparatus for attachment to a basketball backboard and basket attached to the backboard by a flange and suspended above the ground by a means other than a mast, the apparatus being for returning basketballs to a person shooting the same at the basket, the retrieval apparatus comprising:

collection means disposed about the basket, the collection means forming a funnel having an upper, larger opening and a lower, smaller opening the collection means further comprising a cross-support configured for resting on the flange of the basket to support the collection means adjacent the backboard;

a basketball return ramp having a first end and a second end, the first end being disposed adjacent the collection means and below the lower, smaller opening, the basketball return ramp being pivotable adjacent the first end such that arcuate movement of the second end causes the first end to pivot with respect to the collection means;

support means for holding the collection means adjacent the backboard/basket and for holding the first end in a pivotable attachment adjacent the lower opening of the collection means, the support means comprising a wedge pole having opposing ends, one end contacting the ground and the other end contacting the backboard/basket, and a support arm attached to the wedge pole.

24. The basketball retrieval apparatus of claim 23, wherein the wedge pole comprises a base and an extension tube extendable from the base so as to forcibly contact the backboard/basket.

25. The basketball retrieval apparatus of claim 23, wherein the extension tube is movable relative to the base.

* * * * *